US006382121B2

(12) United States Patent
Yu

(10) Patent No.: US 6,382,121 B2
(45) Date of Patent: May 7, 2002

(54) BOAT BALLAST SYSTEM

(76) Inventor: Alfred Yu, 1923 - 73 Street, Edmonton, Alberta (CA), T6K 2B6

( * ) Notice: Subject to any disclaimer, the term of this patent is extended or adjusted under 35 U.S.C. 154(b) by 0 days.

(21) Appl. No.: 09/731,528

(22) Filed: Dec. 6, 2000

(51) Int. Cl.[7] ..... B63B 39/00
(52) U.S. Cl. ..... 114/122; 114/124; 114/141
(58) Field of Search ..... 114/121, 122, 114/124, 126, 140, 141, 143

(56) References Cited

U.S. PATENT DOCUMENTS

| | | | | | |
|---|---|---|---|---|---|
| 180,690 | A | * | 8/1876 | Winans | 114/141 |
| 685,648 | A | * | 10/1901 | Schoenhut | 114/141 |
| 803,174 | A | * | 10/1905 | Lake | 114/124 |
| 1,105,303 | A | * | 7/1914 | Preiczer | 114/122 |
| 1,331,202 | A | * | 2/1920 | Kitchen et al. | 114/124 |
| 3,460,501 | A | * | 8/1969 | Silverman | 114/122 |
| 3,985,106 | A | | 10/1976 | Ross | 114/91 |
| 3,996,875 | A | | 12/1976 | Isenberg, Jr. | 114/144 |
| 4,067,280 | A | | 1/1978 | Serfess | 114/128 |
| 4,273,060 | A | | 6/1981 | Pavincic | 114/39 |
| 4,398,485 | A | | 8/1983 | Diziere | 114/132 |
| 4,561,371 | A | | 12/1985 | Kelley et al. | 114/61 |
| 4,667,615 | A | | 5/1987 | Marker | 114/132 |
| 4,690,089 | A | | 9/1987 | Marggraff | 114/141 |
| 4,715,306 | A | | 12/1987 | Horais | 114/61 |
| 4,759,552 | A | | 7/1988 | Schutz | 277/12 |
| 5,036,783 | A | | 8/1991 | Ilievsky et al. | 114/138 |
| 5,313,908 | A | | 5/1994 | Kunz | 114/354 |
| 5,377,607 | A | | 1/1995 | Ross | 114/363 |
| 5,503,097 | A | | 4/1996 | Main | 114/132 |
| 5,617,805 | A | | 4/1997 | Frigard | 114/39.1 |
| 5,787,740 | A | | 8/1998 | Huebner | 70/58 |

* cited by examiner

*Primary Examiner*—Stephen Avila
(74) *Attorney, Agent, or Firm*—Bennett Jones LLP

(57) ABSTRACT

A ballast system for a sailing boat includes an elongate body having a first end and a second end. A mounting is provided at the first end of the elongate body for suspending the elongate body from a hull of a sailing boat. A ballast weight is positioned at the second end of the elongate body. A motor and gear assembly are provided for moving the second end of the elongate body relative to the hull of the sailing boat. The described ballast system decreases the amount of ballast weight required without sacrificing the safety of operation of the sail boat. The decrease in ballast weight, decreases the over all displacement of the sail boat, and permits increased speed.

6 Claims, 2 Drawing Sheets

BOAT BALLAST SYSTEM

FIELD OF THE INVENTION

The present invention relates to a boat ballast system

BACKGROUND OF THE INVENTION

Sailing boats typically have a hull, a centreboard depending from the bottom of the hull, a deck or seating, one or more masts with sails attached thereto, means for steering the boat such as a rudder, and lines, pulleys and other apparatus for raising and lowering the sails. Some sailing boats have a cabin or other superstructure. The weight of the combination of the components of the sailing boat determines how much water is displaced by the sailing boat, and consequently the draft of the sailing boat, that is, how deeply within the water the sailing boat floats. A centreboard may be rigidly affixed to and depending from the bottom of the hull of a sailing vessel, or it may be movable and capable of being withdrawn through a well in the hull. U.S. Pat. No. 5,503,097 which issued to Main in 1996 and U.S. Pat. No. 5,036,783 which issued to Ilievsky et al. in 1991 describe examples of movable centreboards that can be withdrawn into a hull of a sailing vessel thereby reducing the draft of the sailing boat while it is being sailed in shallow waters.

When a wind acts on the sails from one or the other side of the sailing boat, the force of the wind on the sails causes the sailing boat to lean to the opposite side. One effect of this leaning is that the sail is no longer substantially vertical and so the propulsive force of the wind on the sails is reduced, and the sailing boat does not move at as great a speed as if the sail received the full force of the wind. A second effect is that a strong wind acting upon the sail can create a turning moment about the longitudinal axis of the sailing boat that is greater than the gravitational force of the weight of the hull of the boat. As a consequence, the sailing boat can be capsized. To counter these effects, ballast can be secured within the bottom of the hull. This has two effects. A desirable effect is that the greater weight of the hull with the ballast increases the gravitational force of the weight of the hull, thus partly overcoming any turning moment arising from the action on the sail of wind from a side of the sailing boat. Consequently, the mast and sail remain in a more upright position, with the results that the sailing boat can travel more rapidly and the chance of the sailing boat capsizing is reduced. An undesirable effect is that the overall weight of the sailing boat is increased, thus increasing the draft and, consequently, the drag of the water on the hull. Therefore use of heavy ballast increases the safety of a sailing boat but reduces the level of performance, in particular, the maximum speed.

SUMMARY OF THE INVENTION

What is required is an improved boat ballast system that improves safety of operation of a sailing boat without sacrificing performance of the sailing boat while it is sailed.

According to the present invention there is provided a ballast system for a sailing boat which includes an elongate body having a first end and a second end. Means is provided, at the first end of the elongate body, for suspending the elongate body from a hull of a sailing boat. A ballast weight is positioned at the second end of the elongate body. Means is provided for moving the second end of the elongate body relative to the hull of the sailing boat.

With the ballast system, as described, the ballast weight located at a remote end of the elongate body provides greater stability than an equivalent ballast weight positioned within the hull of the sailing boat. The ballast weight is movable, however, to permit the sailing boat to sail into shallow waters.

Just as there are various configurations of movable centreboards, there are various ways of moving the elongate body to permit the sailing boat to sail into shallow waters. Beneficial results have been obtained when the means for suspending the elongate body is a first pivotal mounting. This enables the elongate body to be pivotally movable between a first limiting position extending from the pivot position toward a stern of the sailing boat substantially parallel with and closely underlying the hull and a second limiting position depending substantially perpendicular to the hull.

As the orientation of the elongate body is altered, it is preferable that the ballast weight be pivotally mounted to the second end of the elongate body by a second pivotal mounting so that the orientation of the elongate body will also be altered. Best results have been obtained when the ballast weight is elongate with a first end, a second end and a top surface. The second pivotal mounting can then be positioned along the top surface at the centre of balance between the first end and the second end such that the ballast weight maintains an orientation substantially parallel to and underlying the longitudinal axis of the sailing boat regardless of the positioning of the elongate body.

The sailing boat must be capable of maintaining stable movement in a variety of depths of water. Regardless of the type of mechanism adopted, it is preferred that the means for moving the second end of the elongate body relative to the hull of the sailing boat be capable of maintaining the elongate body at any selected position between the first limiting position and the second limiting position.

With the ballast system, as described above, the preferred means for moving the second end of the elongate body relative to the hull includes a gear assembly powered by a motor.

According to another aspect of the present invention there is provided a ballast system for a sailing boat which includes the ballast system described above, in combination with a sail boat, as will hereinafter be further described.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
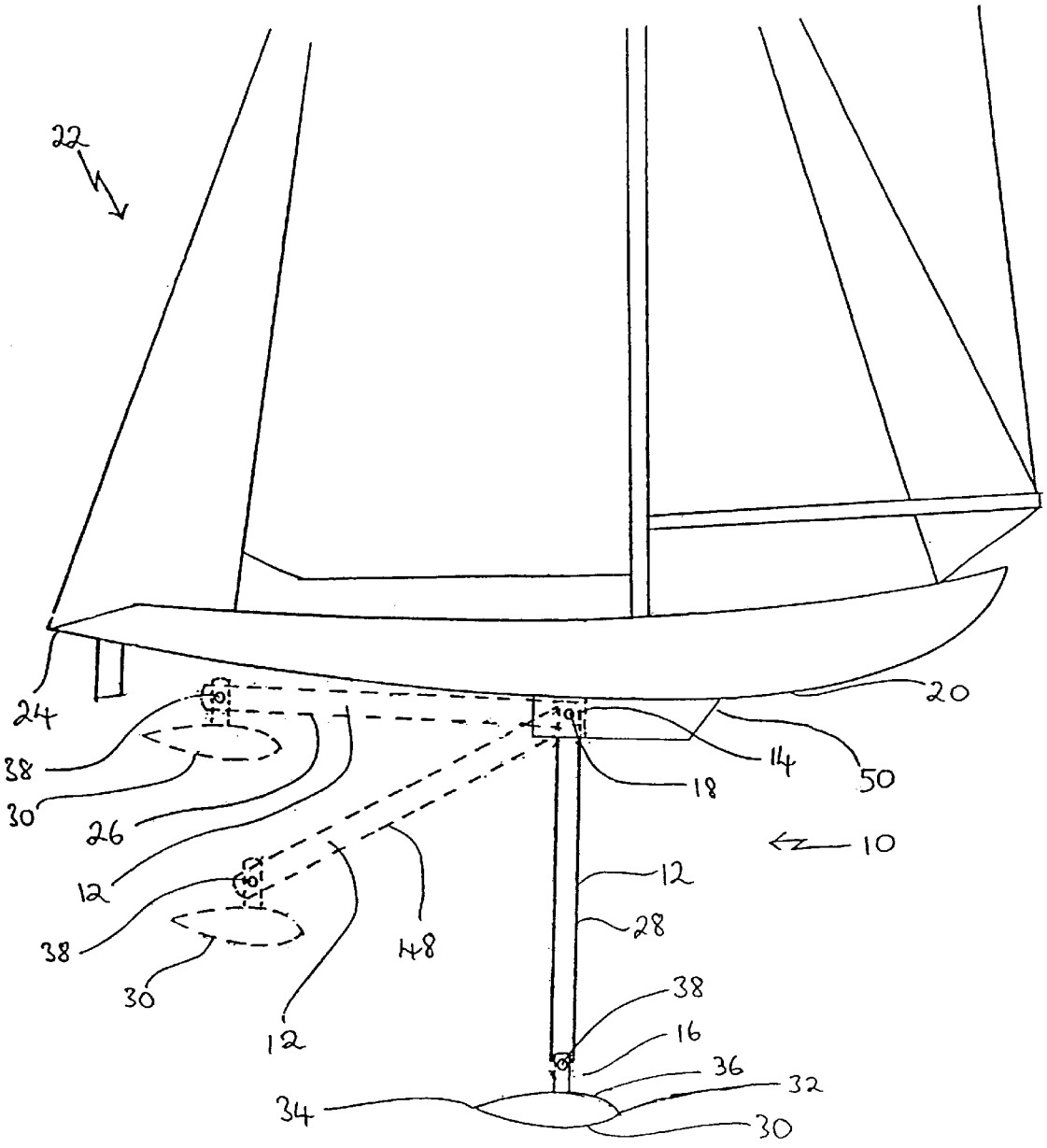
FIG. 1 is a side elevation view of a ballast system for a sailing boat installed on a sailing boat.

The preferred embodiment, a ballast system for a sailing boat generally identified by reference numeral 10, will now be described with reference to FIGS. 1 and 2.

Referring to FIG. 1, ballast system for a sailing boat 10 includes an elongate body 12 having a first end 14 and a second end 16. An elongate ballast weight 30 is secured to second end of elongate body 12. Elongate body 12 has a first pivotal mounting 18 at first end 14 by means of which elongate body 12 is suspended from a hull 20 of a sailing boat 22. Elongate body 12 is pivotally movable between a first limiting position, shown by dashed lines 26 in FIG. 1, and a second limiting position, shown by solid lines 28 in FIG. 1. When elongate body 12 is in the first limiting position, said elongate body 12 extends from the first pivot position 18 toward a stern 24 of sailing boat 22 substantially parallel with and closely underlying hull 20. When elongate body is in the second limiting position, said elongate body 12 depends substantially perpendicular to hull 20. Elongate ballast weight 30 has a first end 32, a second end 34, and a top surface 36. Ballast weight 30 is pivotally mounted by a second pivotal mounting 38 at second end 16 of elongate body 12. Second pivotal mounting 38 is mounted along top surface 36 at the centre of balance between first end 32 and second end 34 such that ballast weight 30 maintains an orientation substantially parallel to and underlying the longitudinal axis of sailing boat 22 regardless of the positioning of elongate body 12.

Figure 2:
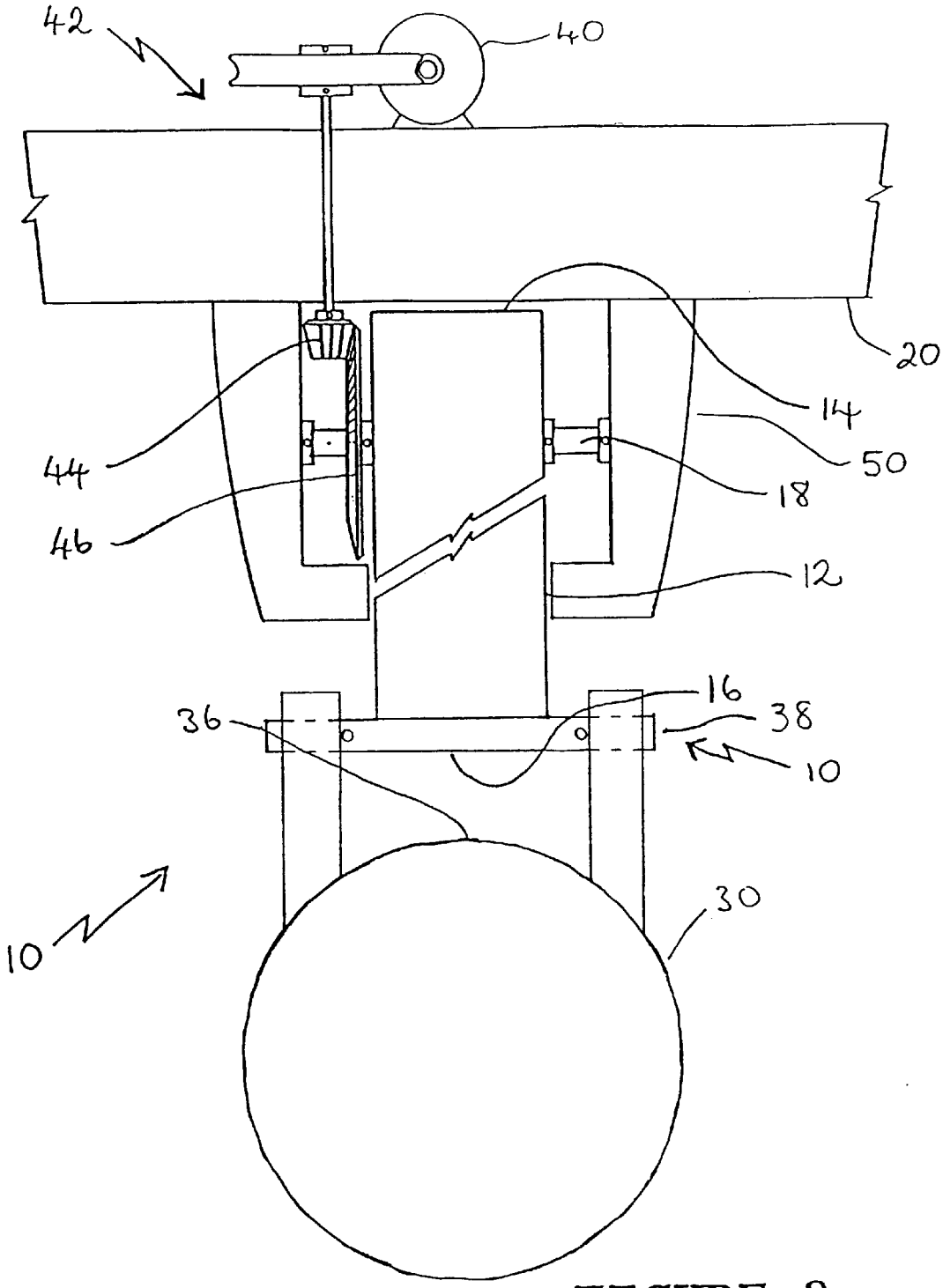
FIG. 2 is a front elevation view, in section, of the ballast system for a sailing boat illustrated in FIG. 1.

Referring to FIG. 2, a motor 40 and gear assembly 42 is provided for moving second end 16 of elongate body 12 relative to hull 20 of sailing boat 22. Motor 40 and gear assembly 42 are located in a housing positioned under the hull and inside of keel 50 of sailing boat 22. Gear assembly 42 includes a drive gear 44 rotated by motor 40 and a driven gear 46 mounted to first end 14 of elongate body 12. Referring to FIG. 1, motor 40 and gear assembly 42 are capable of maintaining elongate body 12 at any selected position between first limiting position and the second limiting position, as shown by way of an example by dashed lines 48.

The use of ballast system 10 in combination with a sailing boat 22 will now be described with reference to FIGS. 1 and 2. Referring to FIG. 1, when sail boat 22 is in shallow water, such as in a harbour or at a mooring, or is sailing in a shallow river or over shoals or other underwater obstructions, elongate body 12 is in first position underlying and substantially parallel with hull 20 of sail boat 22. In first position, ballast weight 30 is in a position closely underlying stern 24 of hull 20 and slightly below keel 50. The draft of sail boat 22 is thereby made as small as possible, and a chance of contact between sail boat 22 and a bed of a river or sea or any underwater obstruction is minimized.

Referring to FIG. 2, when sail boat 22 enters deeper water, elongate body 12 is moved by means of motor 40 and gear assembly 42 to a selected position between first position and second position, such that ballast weight 30 is vertically spaced from hull 20 as illustrated in FIG. 1, but will not contact the bed of the water in which sail boat 22 is sailing. When elongate body 12 is in the selected position, ballast weight 30 is at a greater depth than when elongate body 12 is in first position, thereby providing enhanced stability and performance in operating sail boat 22.

Referring to FIG. 2, when sail boat 22 enters deep water, elongate body 12 is moved by means of motor 40 and gear assembly 42 to second position as illustrated in FIG. 1, depending from keel 50 substantially perpendicular to hull 20. When elongate body 12 is in second position, ballast weight 30 is vertically spaced at a maximum distance from hull 20, and thereby provides for a maximum degree of stability and performance in operating sail boat 22.

The described ballast system decreases the amount of ballast weight required without sacrificing the safety of operation of the sail boat. The decrease in ballast weight, decreases the over all weight of the sail boat, and permits increased speed.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A ballast system for a sailing boat comprising:

a single elongate body having a first end and a second end;

a first pivotal mounting for suspending the elongate body, such that the elongate body is pivotally movable between a first limiting position extending from the pivot position toward a stern of the sailing boat substantially parallel with and closely underlying the hull, and a second limiting position depending substantially perpendicular to the hull;

an elongate ballast weight having a first end, a second end and a top surface, the ballast weight being pivotally mounted by a second pivotal mounting to the second end of the elongate body, the second pivotal mounting being along the top surface at the centre of balance between the first end and the second end such that the ballast weight maintains an orientation substantially parallel to and underlying the longitudinal axis of the sailing boat regardless of the positioning of the elongate body; and means for moving the second end of the elongate body relative to the hull of the sailing boat.

2. The ballast system as defined in claim 1, wherein the means for moving the second end of the elongate body relative to the hull of the sailing boat is capable of maintaining the elongate body at any selected position between the first limiting position and the second limiting position.

3. The ballast system as defined in claim 1, wherein the means for moving the second end of the elongate body relative to the hull includes a gear assembly powered by a motor, the gear assembly including a drive gear rotated by the motor and a driven gear mounted to the first end of the elongate body.

4. A ballast system for a sailing boat comprising:

an elongate body having a first end and a second end;

a first pivotal mounting for suspending the elongate body from a hull of a sailing boat positioned at the first end of the elongate body, such that the elongate body is pivotally movable between a first limiting position extending from the pivot position toward a stern of the sailing boat substantially parallel with and closely underlying the hull, and a second limiting position depending substantially perpendicular to the hull;

an elongate ballast weight having a first end, a second end and a top surface, the ballast weight being pivotally mounted by a second pivotal mounting at the second end of the elongate body, the second pivotal mounting being along the top surface at the centre of balance between the first end and the second end such that the ballast weight maintains an orientation substantially parallel to and underlying the longitudinal axis of the sailing boat regardless of the positioning of the elongate body; and a motor and gear assembly for moving the second end of the elongate body relative to the hull of the sailing boat, the gear assembly including a drive gear rotated by the motor and a driven gear mounted to the first end of the elongate body.

5. The ballast system as defined in claim 4, wherein motor and gear assembly are capable of maintaining the elongate body at any selected position between the first limiting position and the second limiting position.

6. A sail boat having a ballast system as claimed in claim 1 or 4.

* * * * *